US011174865B2

(12) United States Patent
Moon et al.

(10) Patent No.: US 11,174,865 B2
(45) Date of Patent: Nov. 16, 2021

(54) HERMETIC COMPRESSOR HAVING INLET PORT ARRANGEMENT INCLUDING A SUCTION PASSAGE DEFINED IN AN INTERMEDIATE PLATE

(71) Applicant: LG ELECTRONICS INC., Seoul (KR)

(72) Inventors: Seokhwan Moon, Seoul (KR); Seoungmin Kang, Seoul (KR); Jinung Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 519 days.

(21) Appl. No.: 15/926,254

(22) Filed: Mar. 20, 2018

(65) Prior Publication Data

US 2018/0266419 A1 Sep. 20, 2018

(30) Foreign Application Priority Data

Mar. 20, 2017 (KR) ..... 10-2017-0034892

(51) Int. Cl.
*F04C 23/00* (2006.01)
*F04C 18/10* (2006.01)
(Continued)

(52) U.S. Cl.
CPC ..... *F04C 23/008* (2013.01); *F04C 15/06* (2013.01); *F04C 18/10* (2013.01);
(Continued)

(58) Field of Classification Search
CPC ..... F04C 15/06; F04C 18/10; F04C 18/3562; F04C 18/3564; F04C 2210/26;
(Continued)

(56) References Cited

U.S. PATENT DOCUMENTS 2,048,218 A 7/1936 Philipp
4,543,049 A * 9/1985 Shibuya ..... F01C 21/0863 418/269
(Continued)

FOREIGN PATENT DOCUMENTS

EP 1568887 8/2005
KR 1020000001097 1/2000
(Continued)

OTHER PUBLICATIONS

English Machine Translation of KR101120809B1, translated on Jun. 4, 2020 from Espacnet (Year: 2012).*
European Extended Search Report in European Application, dated May 28, 2018, 7 pages.
Patent Cooperation Treaty Search Report in Patent Cooperation Treaty Application No. PCT/KR2018/002822, dated Jun. 19, 2018, 15 pages.

*Primary Examiner* — Mary Davis
*Assistant Examiner* — Paul W Thiede
(74) *Attorney, Agent, or Firm* — Fish & Richardson P.C.

(57) ABSTRACT

A hermetic compressor includes a casing, a cylinder in the casing, a first bearing and a second bearing defining a compression space together with the cylinder, a roller located at an eccentric position with respect to an inner surface of the cylinder and configured to vary a volume of the compression space, and a vane inserted into the roller to rotate together with the roller, and drawn out toward the inner surface of the cylinder to divide the compression space into compression chambers. An inlet port in communication with the compression space is defined in the first bearing, and an intermediate plate is located between the cylinder and the inlet port and defines a suction passage connected to the inlet port, where a peripheral length of an inner peripheral surface of the suction passage is greater than a peripheral length of an outer peripheral surface of the suction passage.

18 Claims, 12 Drawing Sheets

(51) Int. Cl.
*F04C 29/02* (2006.01)
*F04C 18/356* (2006.01)
*F04C 15/06* (2006.01)

(52) U.S. Cl.
CPC ..... *F04C 18/3562* (2013.01); *F04C 18/3564* (2013.01); *F04C 29/023* (2013.01); *F04C 2240/30* (2013.01)

(58) Field of Classification Search
CPC .. F04C 2240/30; F04C 23/008; F04C 29/023; F04C 15/064; F04C 18/3441; F04C 2250/102; F04C 2250/30; F04C 28/10; F04C 29/0035; F04C 2/344; F04C 29/12; F01C 21/106
USPC ..... 418/63, 64, 65, 225, 228, 259, 264, 267, 418/268
See application file for complete search history.

(56) References Cited

U.S. PATENT DOCUMENTS

| | | | | |
|---|---|---|---|---|
| 2013/0084202 | A1 | 4/2013 | Takahashi et al. | |
| 2015/0147216 | A1 | 5/2015 | Shimaguchi et al. | |
| 2015/0211519 | A1* | 7/2015 | Tabata ..... | F04C 18/344 417/410.3 |

FOREIGN PATENT DOCUMENTS

| | | |
|---|---|---|
| KR | 1020110004216 | 1/2011 |
| KR | 1020150083368 | 7/2015 |
| KR | 1020150102531 | 9/2015 |
| KR | 1020160082605 | 7/2016 |
| WO | WO2004102005 | 11/2004 |

* cited by examiner

HERMETIC COMPRESSOR HAVING INLET PORT ARRANGEMENT INCLUDING A SUCTION PASSAGE DEFINED IN AN INTERMEDIATE PLATE

CROSS-REFERENCE TO RELATED APPLICATION

Pursuant to 35 U.S.C. § 119(a), this application claims the benefit of earlier filing date and right of priority to Korean Application No. 10-2017-0034892, filed on Mar. 20, 2017, the contents of which is incorporated by reference herein in its entirety.

FIELD

The present disclosure relates to a hermetic compressor, and particularly, to a vane rotary compressor.

BACKGROUND

A general rotary compressor is a compressor in which a roller and a vane are in contact with each other and a compression space of a cylinder is divided into a suction chamber and a discharge chamber based on the vane. In this general rotary compressor (hereinafter, it is used in combination with a rotary compressor), when the roller makes a rotational movement, the vane moves linearly, so that the suction chamber and the discharge chamber form a compression chamber whose volume is varied to suck, compress, and discharge a refrigerant.

In contrast to such a rotary compressor, a vane rotary compressor is also known in which a vane is inserted into a roller and rotated together with the roller to form a compression chamber while being drawn out by a centrifugal force and a back pressure. In the vane rotary compressor, generally, while a plurality of vanes rotate together with the rollers, a sealing surface of the vanes slides in a state of being in contact with an inner circumferential surface of the cylinder, so that a friction loss is increased as compared with a general rotary compressor.

In the vane rotary compressor, an inner circumferential surface of a cylinder is formed in a circular shape. In recent years, however, a vane rotary compressor (hereinafter, a hybrid rotary compressor) having a so-called hybrid cylinder for increasing compression efficiency, while reducing frictional loss, by forming an inner circumferential surface of the cylinder to have a circular shape is introduced.

FIG. 1 is a longitudinal cross-sectional view showing a conventional vane rotary compressor, and FIG. 2 is a cross-sectional view of a compression part in FIG. 1.

As illustrated, in the conventional vane rotary compressor, an electrical driving unit 20 is installed in an inner space 11 of a casing 10, and a compression part 30 is disposed under the casing 10. The electrical driving unit 20 and the compression part 30 are connected by a rotary shaft 40.

A refrigerant suction pipe 15 penetrates a lower part of the casing 10 and is directly coupled to a cylinder 33 of the compression part which will be described later. A refrigerant discharge pipe 16 penetrates the upper part of the casing 10 to communicate with the inner space 11 of the casing.

The compression part includes a main bearing 31 fixed to an inner circumferential surface of the casing 10, a sub bearing 32 fixedly coupled to the main bearing 31, and a cylinder 33 provided between the main bearing 31 and the sub bearing 32, a roller 34 integrally provided on the rotary shaft 40 and rotatably coupled to the cylinder 33, and a plurality of vanes 35 slidably inserted into the roller 34 to rotate together with the roller 34 and having one end contacting the inner circumferential surface of the cylinder 33 to form a compression chamber V.

The cylinder 33 has a compression space S formed at the center thereof and has an inlet port 33*a* penetrating in a radial direction between one side of an outer circumferential surface of the cylinder 33 and an inner circumferential surface of the compression space S. The inlet port 33*a* is formed in a circular cross-sectional shape.

Also, as illustrated in FIG. 2, the compression space S of the cylinder 33 is formed in an oval shape, and the roller 34 is formed in a circular shape so that a rotation center of the roller 34 is located to be slightly eccentric with the center of the compression space S. Thus, one side of the outer circumferential surface of the roller 34 abuts on one side of the compression space S of the cylinder 33, so that the compression space S may be divided into a plurality of spaces, that is, a suction chamber and a compression chamber.

The inlet port 33*a* is formed on one side of a contact point P between the cylinder 33 and the roller 34 and a plurality of outlet ports 33*b*1 and 33*b*2 are formed on the other side.

Reference numeral 21 denotes a stator, 22 denotes a rotor, 33*c* denotes an inner circumferential surface of the cylinder, 34*a* denotes a vane slot, 34*b* denotes a back pressure hole, 35*a* denotes a sealing surface of the vane, and 36*a* and 36*b* denote discharging valves.

In the conventional vane type rotary compressor as described above, when power is applied to the motor part 20, the rotor 22 of the motor part 20 rotates to rotate the rotary shaft 40, and the rotary shaft 40 rotates the roller 34 to suck, compress, and discharge a refrigerant.

At this time, the refrigerant is sequentially sucked into the plurality of compression spaces S1, S2, S3 formed by the plurality of vanes 35 through the inlet port 33*a*, and the sucked refrigerant is compressed as the plurality of compression spaces S1, S2 and S3 are moved along the inner circumferential surface of the cylinder 33 according to rotation of the roller 34 and discharged to the inner space 11 of the casing 10 through the plurality of outlet ports 33*b*1 and 33*b*2, and this process is repeated.

However, in the vane type rotary compressor described above, as the inlet port 33*a* is formed in the cylinder 33, a specific portion of the vane 35 and the cylinder 33 is worn out to cause a compression loss or there is a limitation in securing the area of the inlet port to cause a suction loss.

That is, in the vane type rotary compressor, the vane 35 inserted into the roller 34 is drawn out by a centrifugal force and a back pressure so that its front end surface (sealing surface) 35*a* comes into close contact with the inner circumferential face 33*c* of the cylinder 33. However, when the entire front end surface 35*a* of the vane 35 is not widely in contact with the inner circumferential surface 33*c* of the cylinder 33, excessive contact force is exerted to severely abrade a portion of the vane 35 that contacts the inner circumferential surface of the cylinder 33, and in this case, a sealing force between the vane 35 and the cylinder 33 is lowered to cause leakage between the compression chambers. This may remarkably occur at upper and lower ends (b) of the vane in a section (a) in which the vane 35 passes through the inlet port 33*a* as illustrated in FIGS. 2 and 3.

In view of this, if the area of the inlet port 33*a* is reduced, the suction loss is increased to significantly degrade performance of the compressor. Particularly, when the inlet port 33*a* has a circular cross-sectional shape, an open area of the inlet port 33*a* at a point where a suction stroke starts after the vane 35 passes through the contact point P is minimized to delay a suction completion time, and thus, compression performance due to the suction loss may be deteriorated.

In addition, considering that a suction start time is delayed, if the angle of the suction completion time is delayed toward the back with respect to a compression proceeding direction, a compression period is shortened, causing excessive compression to cause compression loss.

SUMMARY

Therefore, an aspect of the detailed description is to provide a hermetic compressor capable of sufficiently securing a contact area between a cylinder and a vane, while maintaining an area of an inlet port, to suppress local wear between the cylinder and the vane.

Another aspect of the detailed description is to provide a hermetic compressor capable of securing a suction area at a suction start time to prevent the suction start time from being delayed.

Another object of the present invention is to provide a hermetic compressor capable of preventing a suction completion time from being pushed backward to prevent shortening a compression period.

To achieve these and other advantages and in accordance with the purpose of this specification, as embodied and broadly described herein, a hermetic compressor includes: a cylinder; a plurality of bearings provided on upper and lower sides of the cylinder; a roller rotatably provided in a compression space; and at least one vane inserted into the roller and rotated together, drawn out in an inner circumferential direction of the cylinder when the roller rotates so that a sealing surface separates into a plurality of compression chambers abut on an inner circumferential surface of the cylinder, wherein an inlet port communicating with the compression space is formed in a direction perpendicular to a direction in which the vane is drawn out.

Here, the inlet port may be formed on at least one bearing among the plurality of bearings.

Also, the inlet port may be formed on at least one bearing among the plurality of bearings and an outlet port may be formed on the other bearing.

Also, a minimum axial contact length between the inner circumferential surface of the cylinder and the sealing surface of the vane may be formed to be ½ times or greater of an axial height of the cylinder.

Also, to achieve these and other advantages and in accordance with the purpose of this specification, as embodied and broadly described herein, a hermetic compressor includes: a casing; a cylinder fixedly coupled to an internal space of the casing and having an inner circumferential surface forming a compression space; a first bearing and a second bearing provided on upper and lower sides of the cylinder and forming a compression space together with the cylinder; a roller provided to be eccentric with respect to an inner circumferential surface of the cylinder and varying a volume of the compression space, while rotating; and a vane inserted into the roller to rotate together with the roller, and drawn out toward the inner circumferential surface of the cylinder when the roller rotates to divide the compression space into a plurality of compression chambers, wherein an inlet port communicating with the compression space is formed in the first bearing or the second bearing, and a refrigerant suction pipe penetrating through the casing is inserted to be coupled to the inlet port.

Here, an intermediate plate may be provided between the bearing in which the inlet port is formed, among the first bearing and the second bearing, and the cylinder, and a suction passage allowing the inlet port and the compression space to communicate with each other may be formed in the intermediate plate.

Also, both sectional areas of the suction passage may be different based on a radial center line passing through the center of the roller in a rotation direction, and a sectional area of the suction passage positioned on an upstream side based on the rotation direction of the roller may be larger.

Also, the suction passage may be formed in a shape having a long axis and a short axis.

Here, an outlet of the inlet port may be formed outside a range of the compression space, and a suction passage allowing the inlet port and the compression space to communicate with each other may be formed on an inner circumferential surface of the cylinder.

Also, the suction passage may be formed at an edge of the inner circumferential surface of the cylinder.

Also, both sectional areas of the suction passage in a circumferential direction based on a radial center line may be formed to be different, and a sectional area of the suction passage positioned on an upstream side based on a rotation direction of the roller may be formed to be larger.

Also, the suction passage may be in a shape having a long axis and a short axis.

Also, the suction passage may be formed in a shape different from that of the inlet port.

Also, the sectional area of the suction passage may be smaller than or equal to the sectional area of the inlet port.

Also, the inner circumferential surface of the cylinder may be in an oval shape.

Also, a motor part including a stator and a rotor may be further provided in an internal space of the casing, the rotor of the motor part and the roller may be connected by a rotary shaft, an oil passage may be formed in the rotary shaft, a plurality of vane slots into which the vane is inserted may be formed in the roller, a back pressure hole may be formed in an inner end of the plurality of vane slots, and at least one back pressure chamber allowing the back pressure hole to communicate with the oil passage of the rotary shaft may be formed in the rotary shaft.

Also, to achieve these and other advantages and in accordance with the purpose of this specification, as embodied and broadly described herein, a hermetic compressor includes: a cylinder having an inner circumferential surface forming a compression space; a first bearing and a second bearing provided on upper and lower sides of the cylinder, forming a compression space together with the cylinder, and having an inlet port communicating with the compression space; a roller provided to be eccentric with respect to an inner circumferential surface of the cylinder and varying a volume of the compression space, while rotating; a vane inserted into the roller to rotate together with the roller, and drawn out toward the inner circumferential surface of the cylinder when the roller rotates to divide the compression space into a plurality of compression chambers; and an intermediate plate provided between a bearing where the inlet port is formed and the cylinder and having a suction passage allowing the inlet port and the compression space to communicate with each other.

Here, a sectional area on a side of the suction passage where suction starts based on a circumferential center of the suction passage may be greater than or equal to a sectional area of the opposite side.

Also, to achieve these and other advantages and in accordance with the purpose of this specification, as embodied and broadly described herein, a hermetic compressor includes: a cylinder having an inner circumferential surface forming a compression space; a first bearing and a second bearing provided on upper and lower sides of the cylinder and forming a compression space together with the cylinder; a roller provided to be eccentric with respect to an inner circumferential surface of the cylinder and varying a volume of the compression space, while rotating; and a vane inserted into the roller to rotate together with the roller, and drawn out toward the inner circumferential surface of the cylinder when the roller rotates to divide the compression space into a plurality of compression chambers, wherein an inlet port guiding a refrigerant to the compression space is provided in an axial direction of the vane.

In the vane rotary compressor according to the present invention, the inlet port is not formed in the cylinder but formed on the bearings provided on both upper and lower sides of the cylinder so that a contact area between the cylinder and the vane may be sufficiently secured, while maintaining the area of the inlet port, whereby local wear between the cylinder and the vane may be suppressed.

In addition, since the inlet port is formed in the bearings provided on both upper and lower sides of the cylinder or in a separate member provided between the bearing and the cylinder, a suction start side may be formed to be wide by arbitrarily changing an outlet shape of the inlet port, whereby a suction area at a suction start time can be secured to prevent the suction start time from being delayed.

In addition, since the suction start time is prevented from being delayed, it is possible to prevent a suction completion time from being delayed, thereby preventing a compression period from being shortened.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a vane rotary compressor according to the present invention will be described in detail based on an embodiment shown in the accompanying drawings.

Figure 1:
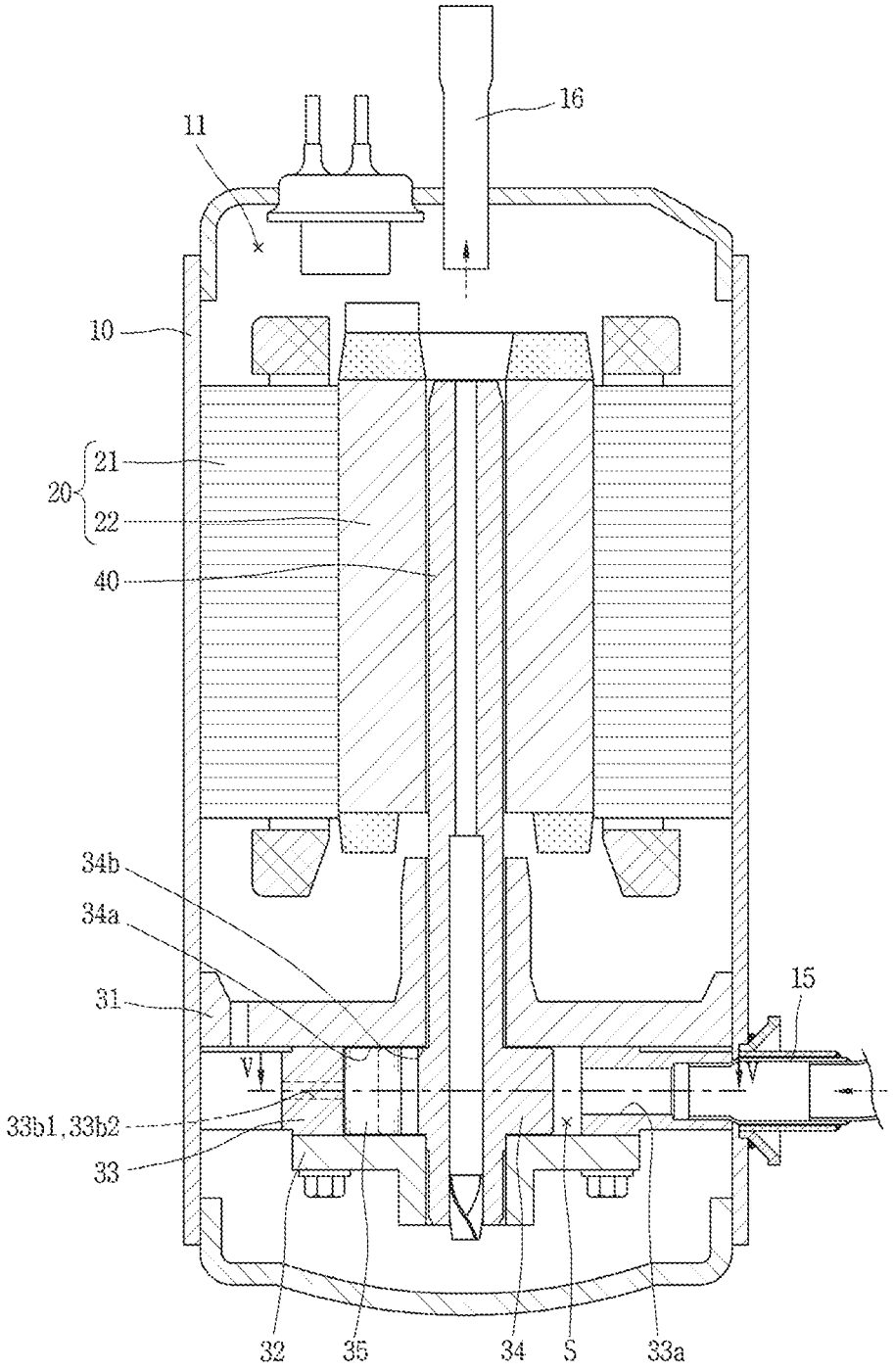
FIG. 1 CONVENTIONAL ART
FIG. 1 is a longitudinal cross-sectional view showing a conventional vane rotary compressor.
Figure 2:
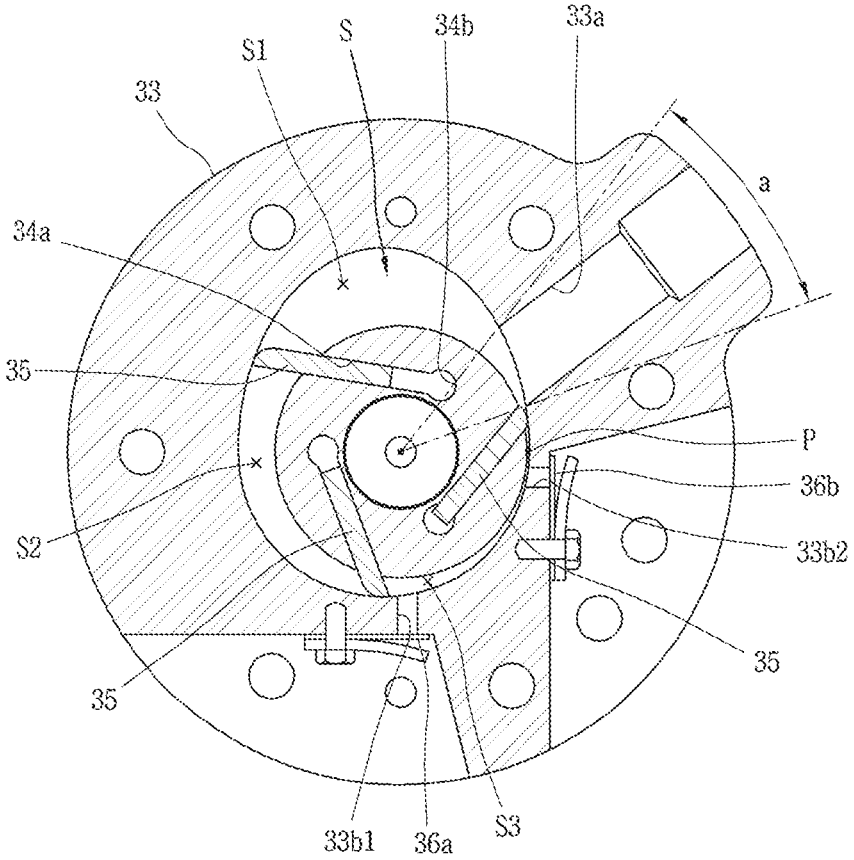
FIG. 2 CONVENTIONAL ART
FIG. 2 is a cross-sectional view taken along line "V-V" in FIG. 1.
Figure 3:
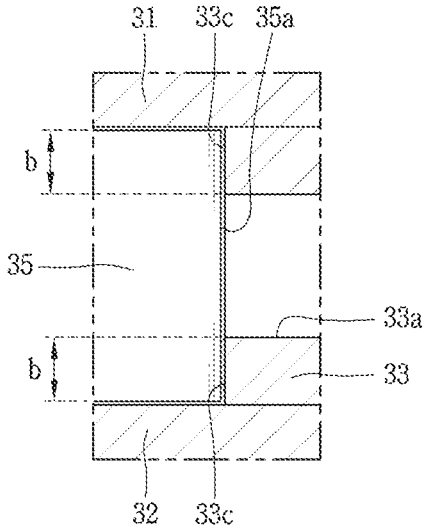
FIG. 3 CONVENTIONAL ART
FIG. 3 is a cross-sectional view showing a contact state between a cylinder and a vane at the time when the vane passes through an inlet port in FIG. 1.
Figure 4:
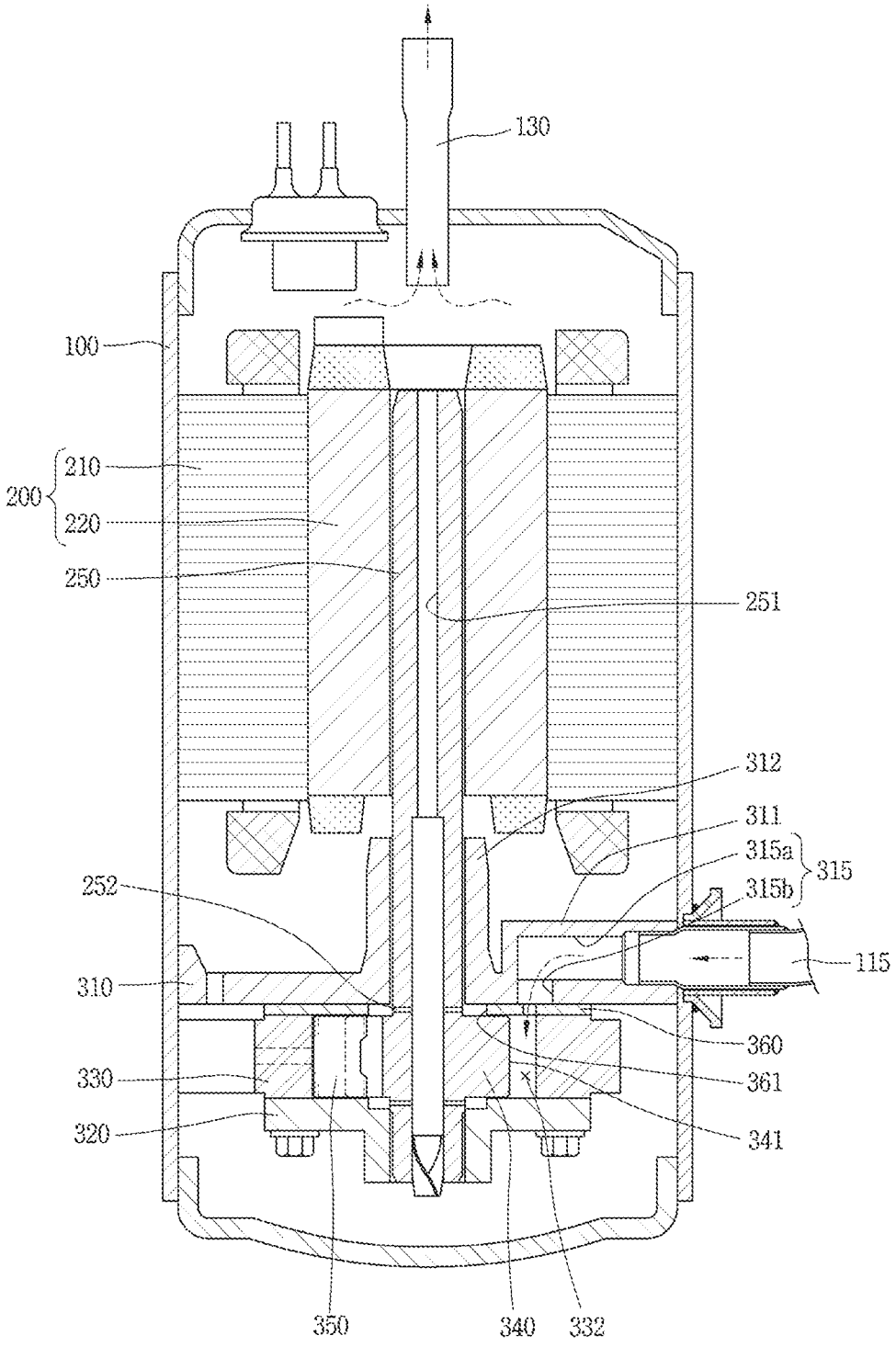
FIG. 4 is a longitudinal sectional view showing a vane rotary compressor according to the present invention.
Figure 5:
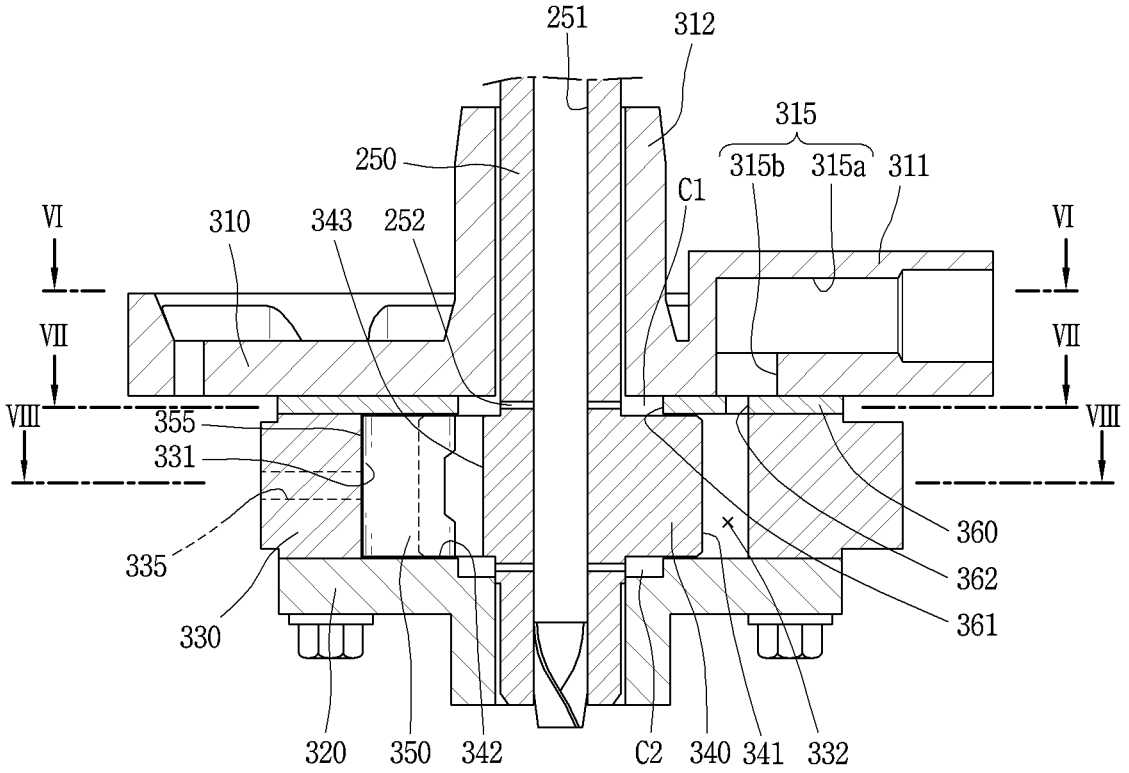
FIG. 5 is an enlarged longitudinal sectional view showing a compression part in FIG. 4.

FIG. 4 is a longitudinal sectional view showing a vane rotary compressor according to the present invention, and FIG. 5 is an enlarged longitudinal sectional view showing a compression part in FIG. 4.

As illustrated in FIG. 4, in a vane rotary compressor according to the present invention, a motor part 200 is installed in a casing 100, and a compression part mechanically connected by a rotary shaft 250 is installed on one side of the motor part 200. The casing 100 may be classified into a vertical type or a horizontal type in a longitudinal or transverse direction depending on an installation aspect of the compressor. The vertical type is a structure in which the motor part and the compression part are disposed on both upper and lower sides along an axial direction, and the horizontal type is a structure in which the motor part and the compression part are disposed on both left and right sides.

The motor part 200 serves to provide power for compressing a refrigerant. The motor part 200 includes a stator 210 and a rotor 220.

The stator 210 is fixed to the inside of the casing 100 and may be mounted on the inner circumferential surface of the casing 100 by a method such as shrinkage fitting.

The rotor 220 is spaced apart from the stator 210 and is located inside the stator 210. A rotary shaft 250 is press-fit to the center of the rotor 220 and a roller 340 constituting the compression part is integrally formed in or assembled to an end of the rotary shaft 250. Accordingly, when power is applied to the stator 210, a force generated by a magnetic field formed between the stator 210 and the rotor 220 rotates the rotor 220. The power may be transmitted to the compression part by the rotary shaft 250 passing through the center of the rotor 220 as the rotor 220 rotates.

One end of the rotary shaft 250 is press-fit to the rotor 220 and the other end of the rotary shaft 250 is rotatably coupled to a main bearing 310 and a sub-bearing 320, which will be described later. A roller 340 is integrally formed or coupled to the other end of the rotor 220 and is rotatably coupled to a cylinder 330.

A first oil passage 251 is formed at the center of the rotary shaft 250 along the axial direction and a second oil passage 252 is formed in the middle of the first oil passage 251 to penetrate through the first oil passage 251 in the radial direction. This allows a part of oil moving along the first oil passage 251 to move along the second oil passage 252 and to flow into a back pressure hole 343.

The compression part includes a main bearing 310 (hereinafter, a first bearing), a sub-bearing 320 (hereinafter, a second bearing), and a cylinder 330 provided between the first bearing 310 and the second bearing 320 and having a compression space 332.

Figure 6:
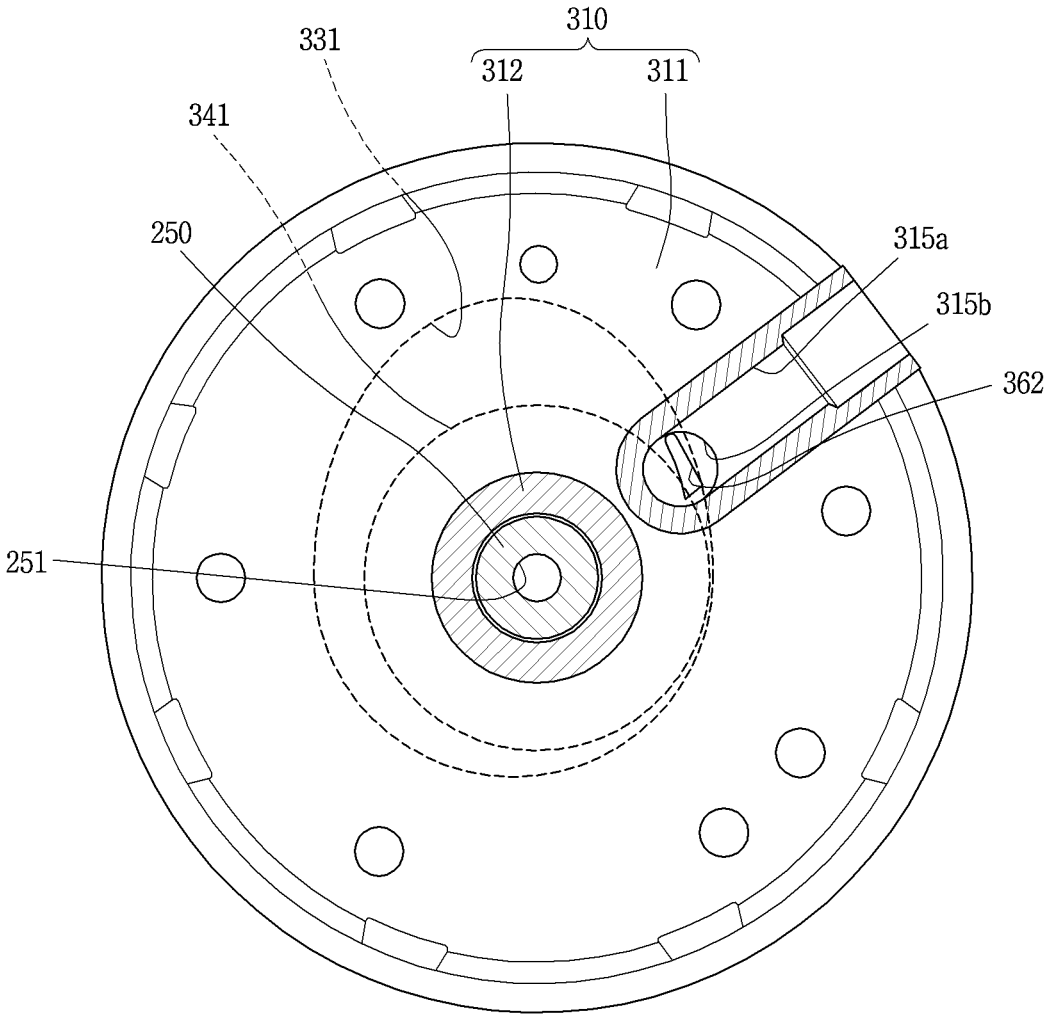
FIG. 6 is a cross-sectional view taken along line "VI-VI" in FIG. 5.
Figure 7:
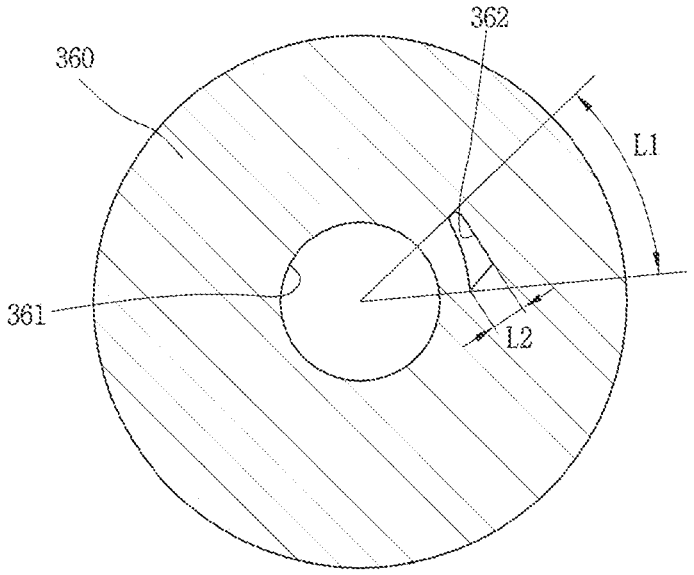
FIG. 7 is a cross-sectional view taken along line "VII-VII" in FIG. 5.

As illustrated in FIGS. 5 and 6, the first bearing 310 includes a first plate portion 311 for covering one side surface of the cylinder 330 and a first shaft accommodating portion 312 protruding from a central portion of the first plate 311 and supporting the rotary shaft 250. The first plate portion 311 has an outer circumferential surface shrinkage-fit or welded to an inner circumferential surface of the casing 100 and an inlet port 315 to which a refrigerant suction pipe 115 is inserted and connected is formed on the inside of the first plate portion 311.

The inlet port 315 has a first hole 315*a* formed on an outer circumferential surface of the first plate portion 311 toward the first shaft accommodating portion 312 and a second hole 315*b* penetrating from the inner end of the first hole 315*a* toward a lower surface of the first plate portion 311.

The first hole 315*a* may be formed to have a circular cross-sectional shape so that the refrigerant suction pipe 115 may be inserted and coupled to the first hole 315*a*. However, any shape may be used as long as the refrigerant suction pipe 115 may be connected. On the other hand, the second hole 315*b* may be formed in the same circular sectional shape as the first hole 315*a*, but when an intermediate plate 360 having a suction passage 362 to be described later is provided, the second hole 315*b* may have a shape corresponding to the suction passage 362.

Here, since the inlet port 315 is formed on the upper side of the cylinder 330, the inlet port 315 is influenced by a radial length of a compression space 332. That is, the inlet port 315 should be formed to be equal to or smaller than the radial length of the compression space 332. However, since an actual radial length of the compression space 332 (a distance between the inner circumferential surface 331 of the cylinder and the outer circumferential surface 341 of the roller) is not sufficiently larger than an inner diameter of the first hole 315*a*, the inner diameter of the second hole 315*b* should be smaller than the radial length of the compression space.

However, if the inner diameter of the second hole 315*b* is formed to be smaller than the radial length of the compression space 332, an outlet sectional area of the inlet port 315 may be reduced to cause a suction loss. Therefore, in order to form the inlet port 315 in the first bearing 310, while sufficiently securing the outlet sectional area of the inlet port 315, it is preferable that an outlet of the inlet port 315 is formed as a long non-circular shape in the circumferential direction.

Also, a suction passage including the inlet port 315 may be formed only in the first bearing 310. However, in this case, sizes and shapes of the first hole 315*a* and the second hole 315*b* constituting the inlet port 315 should be different, so the first bearing 310 may be difficult to manufacture. Therefore, an intermediate plate having a suction passage communicating with the inlet port 315 may be provided between the first bearing 310 and the cylinder 330.

For example, as illustrated in FIGS. 5 to 8B, the intermediate plate 360 is formed in an annular shape having a shaft hole 361 so that the rotary shaft 250 may be rotatably inserted, and a suction passage 362 is formed in the vicinity of the shaft hole 361. The suction passage 362 is formed at a position communicating with the second hole 315*b* of the inlet port 315.

The suction passage 362 may be formed such that a radial length L2 is shorter than a circumferential length L1. In particular, considering that a suction stroke is performed, while the roller 340 and the vane 350 move in the circumferential direction as in the present embodiment, it is preferable that a sectional area on the side where suction is started is greater than or at least equal to the sectional area on the side where the suction is completed.

Figure 8A:
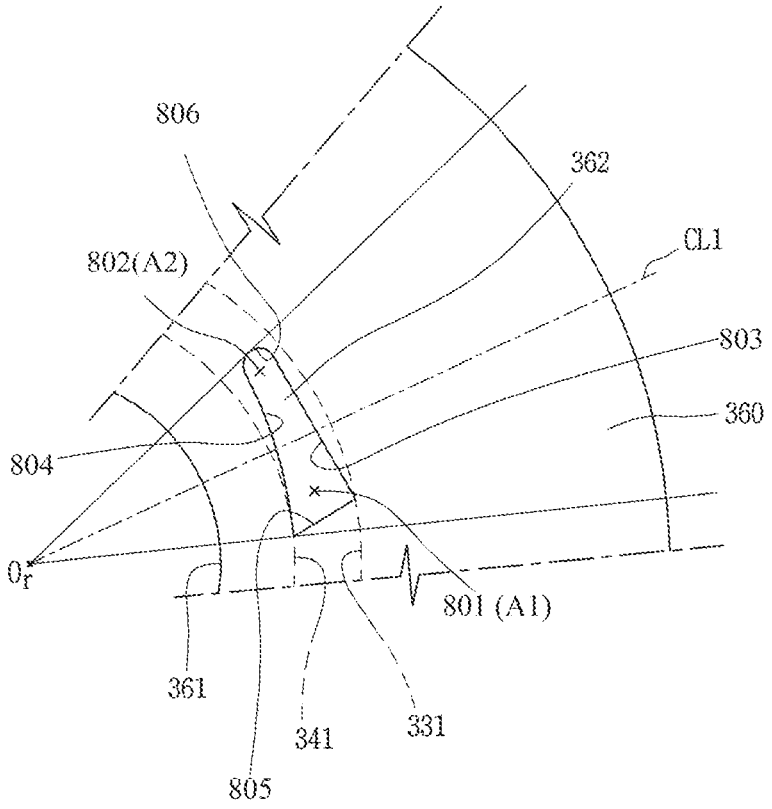
FIGS. 8A and 8B are an enlarged schematic view showing a suction passage in FIG. 7 and a schematic view showing a suction area at a suction start time.

To this end, as illustrated in FIG. 8A, the suction passage 362 may be formed such that a sectional area A1 of a first portion 801 on an upstream side is greater than or at least equal to a sectional area A2 of a second portion 802 on a downstream side with respect to a radial center line CL1 passing through the center in a circumferential direction thereof. The suction passage 362 may have an outer peripheral surface 803 and an inner peripheral surface 804 that is spaced apart from the outer peripheral surface 803 in a radial direction. The inner peripheral surface 804 may have a curved shape that extends from a first end 805 of the suction passage 362 to a second end 806 of the suction passage 362 along a circumferential direction of the cylinder 330.

Figure 8B:
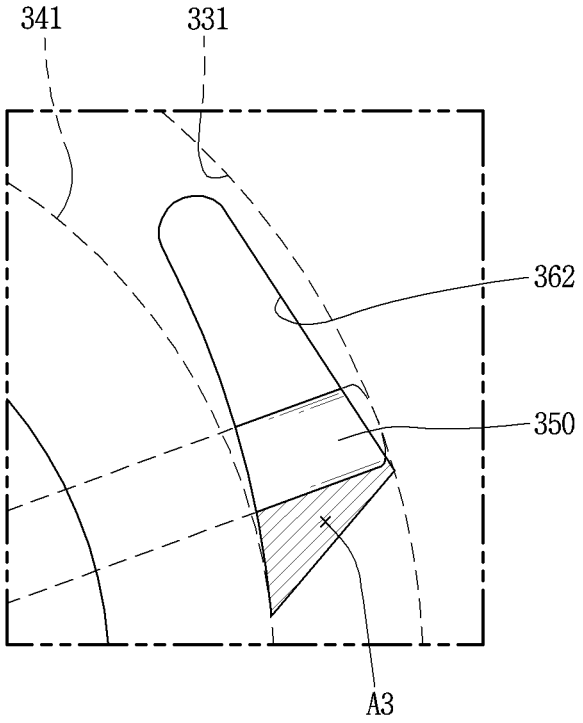

Thus, as shown in FIG. 8B, a suction area A3 is sufficiently secured at the time when the vane 350 starts to pass through the suction passage 362, that is, at the time (suction start time) when the suction stroke starts for the corresponding compression chamber, whereby the suction start time is prevented from being delayed and rather can be advanced. Also, a suction completion time is prevented from being delayed or advanced to extend a compression cycle to suppress excessive compression.

Also, since the inlet port 315 is not formed to penetrate through the inner circumferential surface of the cylinder 330 to be described later, an area in which a sealing surface of the vane 350 contacts the inner circumferential surface of the cylinder 330 can be maintained to be the same. As a result, the contact surface between the cylinder 330 and the vane 350 is prevented from being partially worn and refrigerant leakage between the compression chambers may be prevented in advance.

Meanwhile, the inner circumferential surface of the cylinder 330 according to the present embodiment is formed in an oval shape rather than a circular shape. The cylinder 330 may be formed in a symmetrical oval shape having a pair of long axis and a short axis or may be formed in an asymmetric oval shape having multiple pairs of long axes and short axes. The asymmetric oval cylinder is generally referred to as a hybrid cylinder, and this embodiment relates to a vane rotary compressor to which a hybrid cylinder is applied.

Figure 9:
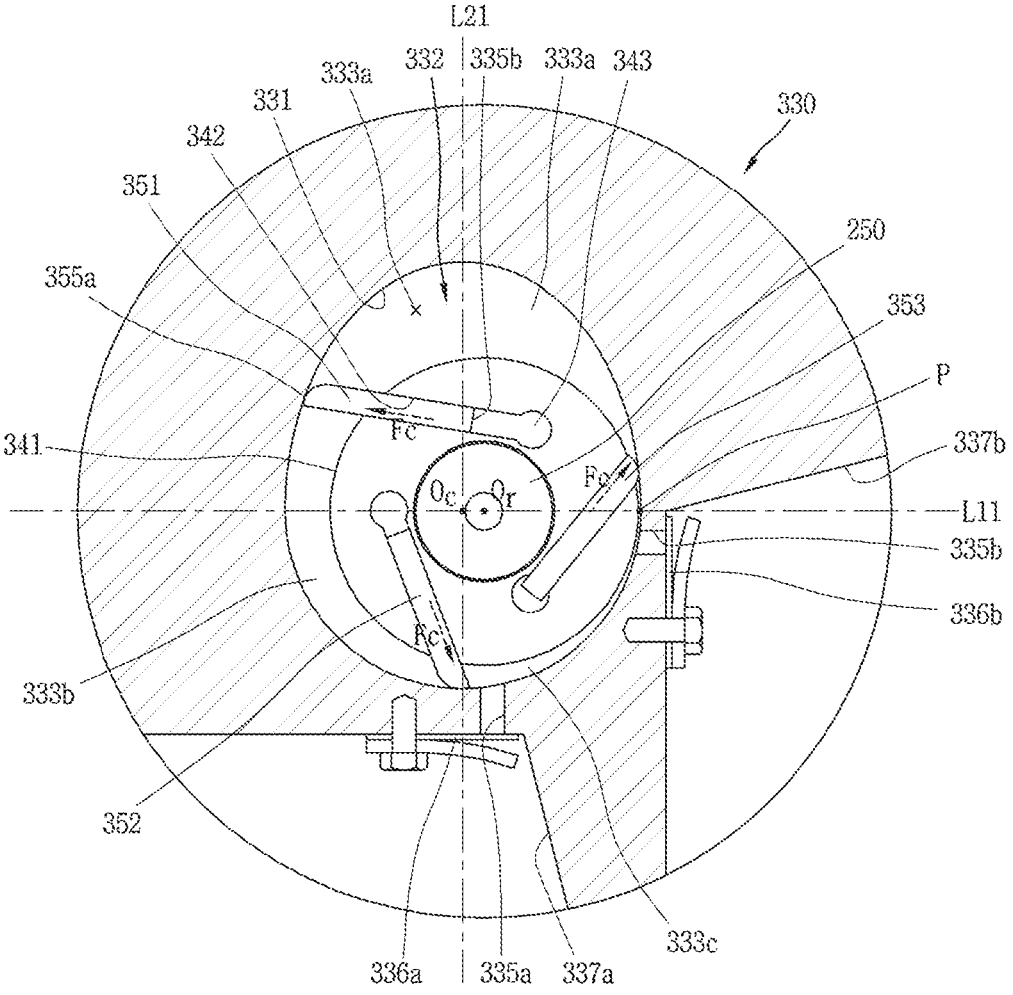
FIG. 9 is a cross-sectional view taken along line "VIII-VIII" in FIG. 5.

As illustrated in FIGS. 4 and 9, the outer circumferential surface of the cylinder 330 according to the present embodiment may be formed in a circular shape, but it may be a shape fixed to the inner circumferential surface of the casing 100 when it does not have a circular shape. Of course, it is preferable that the first bearing 310 or the second bearing 320 is fixed to the inner circumferential surface of the casing 100 and the cylinder 330 is bolted to the bearing fixed to the casing 100 to suppress deformation of the cylinder 330.

A hollow space is formed in the center of the cylinder 330 to form the compression space 332 including the inner circumferential surface 331. The hollow space is sealed by a first bearing (specifically, an intermediate plate to be described later) 310 and a second bearing 320 to form the compression space 332. In the compression space 332, a roller 340 to be described later is rotatably coupled.

The inner circumferential surface 331 of the cylinder 330 constituting the compression space 332 may be formed of a plurality of circles. For example, when a line passing through a point (hereinafter, a contact point) P where the inner circumferential surface 331 of the cylinder 330 and the outer circumferential surface 341 of the roller 340 are almost in contact with each other and a center Oc of the cylinder 330 is a first center line L21, one side (upper side in the drawing) may have an overall shape and the other side (lower side in the drawing) may have a circular shape based on the first central line L21.

When a line perpendicular to the first central line and passing through the center Oc of the cylinder 330 is a second center line L11, the inner circumferential surface 331 of the cylinder 330 may be formed symmetrical with respect to each other based on the second central line. Of course, the right and left sides may be formed asymmetrically with respect to each other.

Outlet ports 335*a* and 335*b* are formed on one side in the circumferential direction based on a point where the inner circumferential surface 331 of the cylinder 330 and the outer circumferential surface 341 of the roller 340 are almost in contact with each other.

The outlet ports 335*a* and 335*b* are indirectly connected to a discharge pipe 130 which communicates with the internal space 110 of the casing 100 and is connected to the casing 100. Accordingly, a compressed refrigerant is discharged into the internal space 110 of the casing 100 through the outlet ports 335*a* and 335*b* and is discharged to the discharge pipe 130. Accordingly, the internal space 110 of the casing 100 is kept at a high pressure state, forming discharge pressure.

Also, outlet ports 335*a* and 335*b* are provided with discharge valves 336*a* and 336*b* for opening and closing the outlet ports 335*a* and 335*b*. The discharge valves 336*a* and 336*b* may be reed-type valves in which one end is fixed and the other end forms a free end. However, the discharge valves 336*a* and 336*b* may be variously applied as needed, such as a piston valve, or the like, in addition to the reed-type valve.

When the discharge valves 336*a* and 336*b* are reed-type valves, valve recesses 337*a* and 337*b* are formed on the outer circumferential surface of the cylinder 330 so that the discharge valves 336*a* and 336*b* may be mounted. Accordingly, a length of the outlet ports 335*a* and 335*b* is minimized to reduce a dead volume. The valve recesses 337*a* and 337*b* may be formed in a triangular shape to secure a flat valve seat surface as shown in FIG. 9.

On the other hand, a plurality of outlet ports 335*a* and 335*b* are formed along a compression path (compression proceeding direction). For convenience, among the plurality of outlet ports 335*a* and 335*b*, an outlet port positioned on the upstream side with respect to the compression path is referred to as a sub-outlet port (or a first outlet port) 335*a* and an outlet port positioned on the downstream side is referred to as a main outlet port (or a second outlet port) 335*b*.

However, the sub-outlet port is not an essential component and may be selectively formed as necessary. For example, if the inner circumferential surface 331 of the cylinder 330 is formed to have a long compression period to appropriately reduce excessive compression of the refrigerant as in the present embodiment as described later, the sub-outlet port may not be formed. However, in order to minimize an over-compression amount of the compressed refrigerant, the conventional sub-outlet port 335*a* may be formed in the front side of the main outlet port 335*b*, that is, on the upstream side of the main outlet port 335*b* with respect to the compression proceeding direction.

Meanwhile, the roller 340 described above is rotatably provided in the compression space 332 of the cylinder 330. The outer circumferential surface of the roller 340 is formed in a circular shape, and the rotary shaft 250 is integrally coupled to the center of the roller 340. Accordingly, the roller 340 has a center Or matching an axial center of the rotary shaft 250 and rotates together with the rotary shaft 250 based on the center Or of the roller.

Also, the center Or of the roller 340 is eccentric with respect to the center Oc of the cylinder 330, that is, the center of the inner space of the cylinder 330 so that one side of the outer circumferential surface 341 of the roller 340 is almost in contact with the inner circumferential surface of the cylinder 330. Here, when a point of the cylinder 330 with which one side of the roller 340 is almost in contact is a contact point P, the contact point P may be a position at which the first center line L21 passing through the center of the cylinder 330 corresponds to a short axis of an oval curve constituting the inner circumferential surface 331 of the inner circumferential surface 331 of the cylinder 330.

The roller 340 has a vane slot 342 formed at an appropriate position along the circumferential direction on the outer circumferential surface 341 thereof, and a back pressure hole 343 which allows oil (or refrigerant) to be introduced to press the vanes 351, 352, 353 in the direction of the inner circumferential surface of the cylinder 330 may be formed on an inner end of each vane slot 342.

Upper and lower back pressure chambers C1 and C2 may be respectively formed on upper and lower sides of the back pressure hole 343 so as to supply oil to the back pressure hole 343.

The back pressure chambers C1 and C2 are formed by the upper and lower sides of the roller 340, the first bearing 310 and the second bearing 320 corresponding thereto, and the outer circumferential surface of the rotary shaft 250. However, when the intermediate plate 360 is installed between the first bearing 310 and the cylinder 330 as in the present embodiment, the upper back pressure chamber C1 may be formed by the first bearing 310, the intermediate plate 360, and the upper surface of the roller 340.

The back pressure chambers C1 and C2 may communicate with the second oil passage 252 of the rotary shaft 250 independently but a plurality of back pressure holes 343 may communicate with the second oil passage 252 together through one back pressure chamber C1 or C2.

Referring to the vanes 351, 352 and 353, when a vane closest to the contact point P with reference to the compression proceeding direction is a first vane 351 and a second vane 352 and a third vane 353 follow, the first vane 351 and the second vane 352, the second vane 352 and the third vane 353, and the third vane 353 and the first vane 351 are spaced apart from each other by the same circumferential angle.

Therefore, when a compression chamber formed by the first vane 351 and the second vane 352 is a first compression chamber 333*a*, a compression chamber formed by the second vane 352 and the third vane 353 is a second compression chamber 333*b*, and a compression chamber formed by the third vane 353 and the first vane 351 is a third compression chamber 333*c*, all the compression chambers 333*a*, 333*b*, and 333*c* have the same volume at the same crank angle.

The vanes 351, 352 and 353 are formed in a substantially rectangular parallelepiped shape having pairs of parallel surfaces. Here, a surface of the vane contacting the inner circumferential surface 331 of the cylinder 330, among both ends of the vane in the longitudinal direction, is referred to as a sealing surface 355*a* of the vane and a surface opposed to the back pressure hole 343 is referred to as a back pressure surface 355*b*.

The back pressure surface 355*b* of the vanes 351, 352 and 353 may have a curved shape to line-contact with the inner circumferential surface 331 of the cylinder 330, and the back pressure surface 355*b* of the vanes 351, 352, and 353 may be formed to be flat so as to be inserted into the back pressure hole 343 to receive back pressure evenly.

In the vane rotary compressor equipped with the hybrid cylinder as described above, power is applied to the motor part 200 so the rotor 220 of the motor part 200 and the rotary shaft 250 coupled to the rotor 220 rotate, the roller 340 rotates together with the rotary shaft 250.

Then, the vanes 351, 352 and 353 are drawn out from the roller 340 by a centrifugal force Fc generated by the rotation of the roller 340 and a back pressure formed on the first back pressure surface 355*b* of the vanes 351, 352 and 353, so that the sealing surfaces 355*a* of the vanes 351, 352 and 353 is brought into contact with the inner circumferential surface 331 of the cylinder 330.

The compression space 332 of the cylinder 330 forms the compression chambers 333*a*, 333*b* and 333*c* as many as the number of the vanes 351, 352 and 353 by the plurality of vanes 351, 352 and 353. As the compression chambers 333*a*, 333*b* and 333*c* are moved according to the rotation of the roller 340, the volume thereof is varied by the shape of the inner circumferential surface 331 of the cylinder 330 and the eccentricity of the roller 340, and the refrigerant filled in the compression chambers 333*a*, 333*b*, and 333*c* moves along the roller 340 and the vanes 351, 352 and 353, so as to be sucked, compressed, and discharged, and this sequential process is repeated.

This will be described in more detail as follows.

That is, based on the first compression chamber 333*a*, until the first vane 351 passes through the suction passage 362 and the second vane 352 reaches the suction completion time, the volume of the first compression chamber 333*a* is continuously increased so the refrigerant continuously flows from the inlet port 315 to the first compression chamber 333*a*.

Next, when the second vane 352 reaches the suction completion time (or the compression start angle), the first compression chamber 333*a* is sealed and moves together with the roller 340 toward the outlet port. In this process, the volume of the first compression chamber 333*a* is continuously reduced and the refrigerant in the first compression chamber 333*a* is gradually compressed.

Next, when the first vane 351 passes through the first outlet port 335*a* and the second vane 352 does not reach the first outlet port 335*a*, the first compression chamber 333*a* communicates with the first outlet port 335*a* and the first discharge valve 336*a* is opened by pressure of the first compression chamber 333*a*. Then, a part of the refrigerant in the first compression chamber 333*a* is discharged into the internal space 110 of the casing 100 through the first outlet port 335*a* and pressure of the first compression chamber 333*a* is lowered to a predetermined pressure. Of course, in the absence of the first outlet port 335*a*, the refrigerant in the first compression chamber 333*a* is not discharged and further moves toward the second outlet port 335*b* as a main outlet port.

Next, when the first vane 351 passes through the second outlet port 335*b* and the second vane 352 reaches the discharge opening angle, the second discharge valve 336*b* is opened by pressure of the first compression chamber 333*a* and the refrigerant in the first compression chamber 333*a* is discharged into the internal space 110 of the casing 100 through the second outlet port 336*b*.

The above-described sequential process is repeated in the second compression chamber 333*b* between the second vane 352 and the third vane 353 and in the third compression chamber 333*b* between the third vane 353 and the first vane 351, and therefore, in the vane rotary compressor according to the present embodiment, discharging is performed three times per revolution of the roller 340 (discharging is performed six times when including discharging from the first outlet port).

Figure 10:
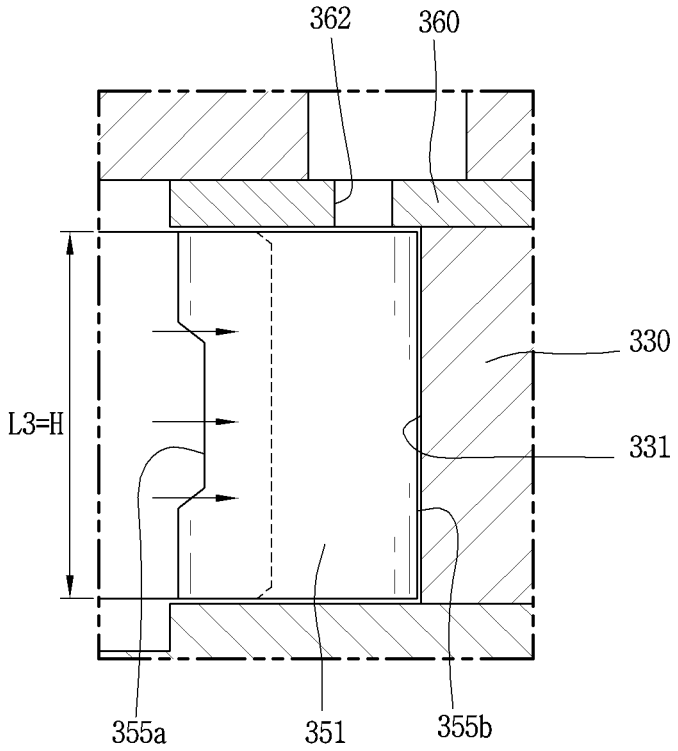
FIG. 10 is a cross-sectional view showing a contact state between the cylinder and the vane at the time when the vane passes through the inlet port in FIG. 5.

On the other hand, when the outlet of the inlet port, that is, the suction passage, is formed on the intermediate plate (or the first bearing) 360 provided on the upper side of the cylinder, not formed on the inner circumferential surface of the cylinder, as in the present embodiment, a support length L3 of the vane with respect to the cylinder 330 is kept the same over most of the inner circumferential surface 331 of the cylinder 330, except for the section in which the outlet port is formed as illustrated in FIG. 10. That is, the support length L3 of the vane is kept substantially equal to a height H of the cylinder. Accordingly, the support length for the contact force of the vane may also be maintained substantially the same in the most sections.

Even though the first outlet port 335*a* and the second outlet port 335*b* are formed on the inner circumferential surface 331 of the cylinder 330, an axial height of these outlet ports is ½ or less of the axial height H of the cylinder, and therefore, the support length L3 between the vane 351 and the cylinder 330 may be secured by ½ or more of the axial length of the vane 351 when the vane passes through the outlet port. In addition, in the section where the outlet port is formed, since the pressure of the compression chamber is high so the vane 351 is pushed toward the roller by the gas repulsive force, so that the contact force between the vane 351 and the cylinder 330 is reduced to reduce a possibility of wear.

Thus, a phenomenon that the vane is locally adhered to the cylinder in the section where the contact force of the vane is high, that is, in the suction section, so a contact surface between the cylinder and the vane is partially worn out can be prevented in advance, and since the contact surface between the cylinder and the vane is not partially worn out, leakage of the refrigerant between the compression chambers may be effectively suppressed.

Figure 11A:
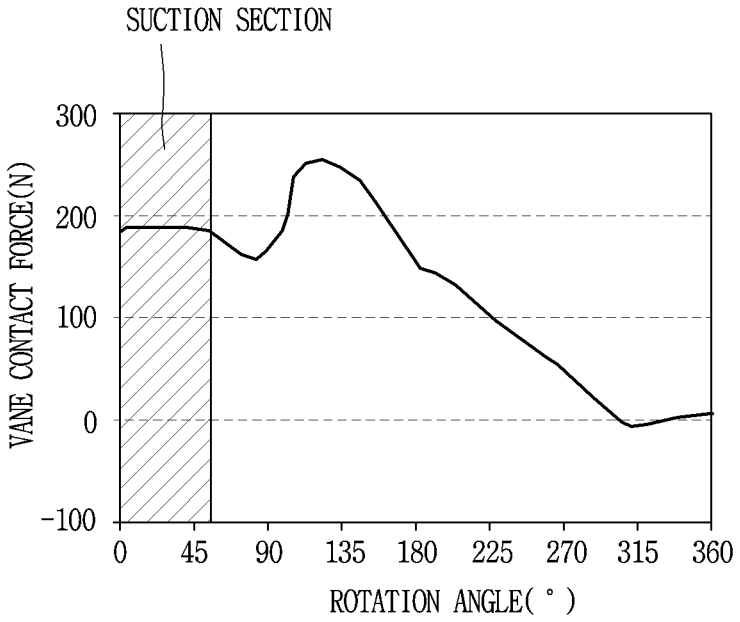
FIG. 11A is a graph showing a vane contact force in a section in which an inlet port is formed in a rotary compressor according to the present embodiment.
Figure 11B:
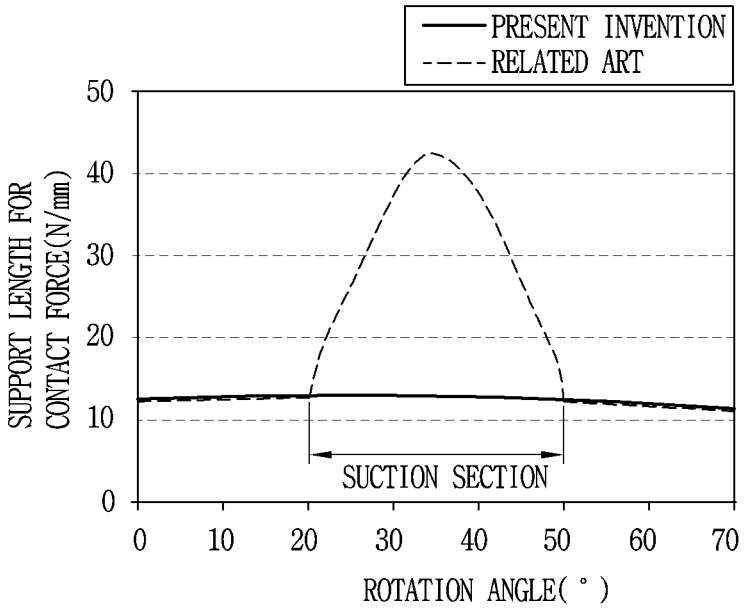
FIGS. 11B and 11C are graphs showing the comparison between a support length of a vane and a support length for a contact force of the vane in the conventional art in which an inlet port is formed on an inner circumferential surface of a cylinder and in the present embodiment in which an inlet port is formed at bearings provided on both upper and lower sides of a cylinder in a rotary compressor according to the present embodiment.
Figure 11C:
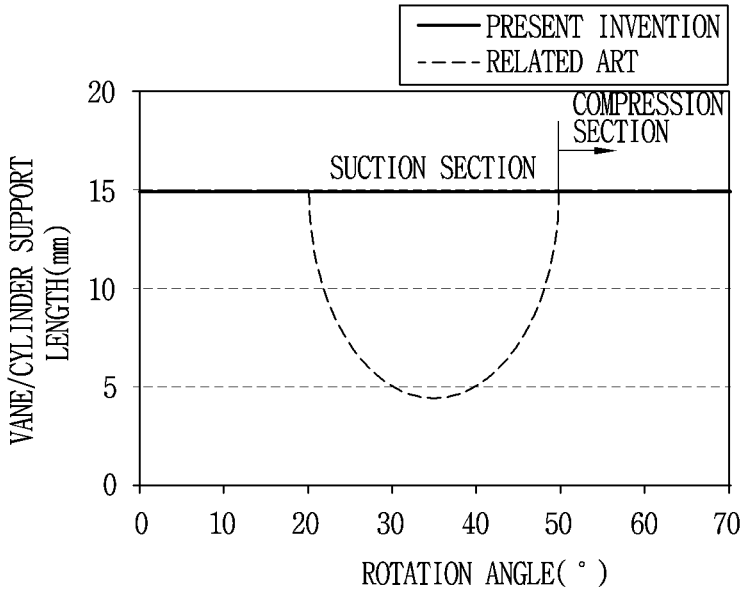

FIG. 11A is a graph showing a vane contact force in a section in which an inlet port is formed in a rotary compressor according to the present embodiment, FIGS. 11B and 11C are graphs showing the comparison between a support length of a vane and a support length for a contact force of the vane in the conventional art in which an inlet port is formed on an inner circumferential surface of a cylinder and in the present embodiment in which an inlet port is formed at bearings provided on both upper and lower sides of a cylinder in a rotary compressor according to the present embodiment.

Referring to these figures, when the inlet port is formed on the inner circumferential surface of the cylinder as in the related art, the support length (mm) of the vane is drastically lowered in the vicinity of about 20° to 50° at which the suction stroke is performed. However, when the inlet port (or the suction passage) is formed in a member located on the upper side of the cylinder as in the present embodiment, the support length (mm) of the vane and the support length (N/mm) for contact force of the vane in most sections including the section where the suction stroke is performed are maintained to be constant.

This is because the suction passage of the present embodiment is not formed on the inner circumferential surface 331 of the cylinder 330 so that the contact area of the vane 351 is kept constant over most of the section and, at the same time, the suction passage is formed to be wider toward the vicinity of the suction start time to secure a sufficient suction area. However, when the inlet port is formed in a circular shape and formed on the inner circumferential surface of the cylinder as in the related art, the contact area between the cylinder and the vane decreases by the area of the inlet port. Therefore, the supporting length of the vane performing the suction stroke and the support length for the contact force are bound to change drastically. In addition, in the related art, since the suction area at the suction start time is not sufficiently secured, both the suction start time and the suction completion time are delayed, so that the suction loss and the compression loss increase to degrade the compressor performance.

Figure 12:
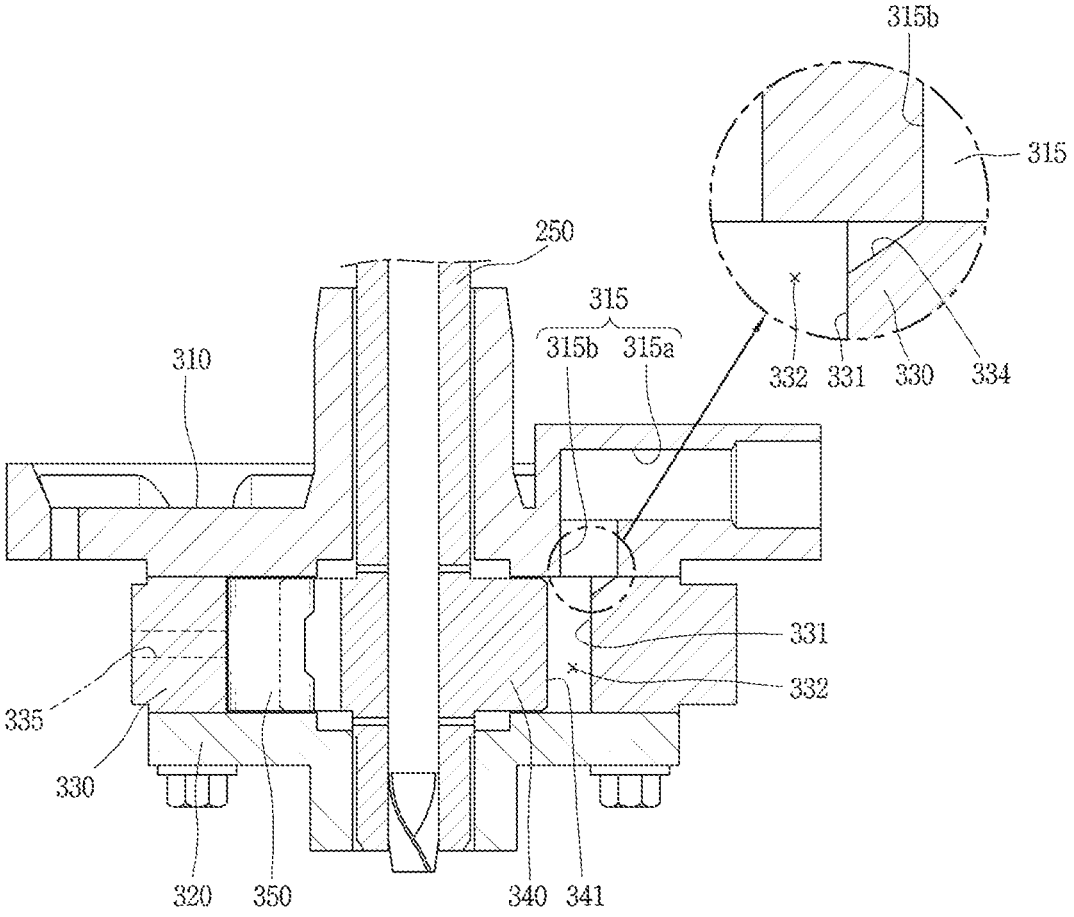
FIGS. 12 and 13 are longitudinal sectional views showing another embodiment of a suction passage according to FIG. 4.

FIG. 12 illustrates another embodiment of the suction passage in the hermetic compressor according to the present disclosure.

That is, in the above-described embodiment, the intermediate plate having the suction passage is provided between the first bearing and the cylinder. However, in the present embodiment, the intermediate plate is eliminated and a suction passage is formed instead at the inner circumferential edge of the cylinder.

For example, as shown in FIG. 12, an inlet port 315 is formed in a first bearing 310 (this is the same in the case of a second bearing), and an suction passage 334 allowing the inlet port 315 of the first bearing and the compression space 332 to communicate with each other may be formed at an edge of an inner circumferential surface 331 of the cylinder 330.

In this case, the second hole 315*b* of the inlet port 315 may be formed outside the compression space 332 as long as it may communicate with the suction passage 334.

Also, in this case, the suction passage 334 is formed to be long in the circumferential direction as in the above-described embodiment, and the sectional area on the suction upstream side may be larger than the sectional area on the downstream side with respect to a radial center line.

Since the inlet port is formed in the first bearing or the second bearing instead of the cylinder in the vane type rotary compressor according to the present embodiment as described above, the vane and the cylinder are prevented from being worn due to a concentrated load applied when the vane passes through the inlet port. A detailed description thereof will be omitted. However, in this embodiment, as the suction passage is formed at the inner circumferential edge of the cylinder, the contact area of the vane in the suction stroke may be somewhat reduced as compared with the above-described embodiment. However, it may be remarkably improved as compared with the related art.

Figure 13:
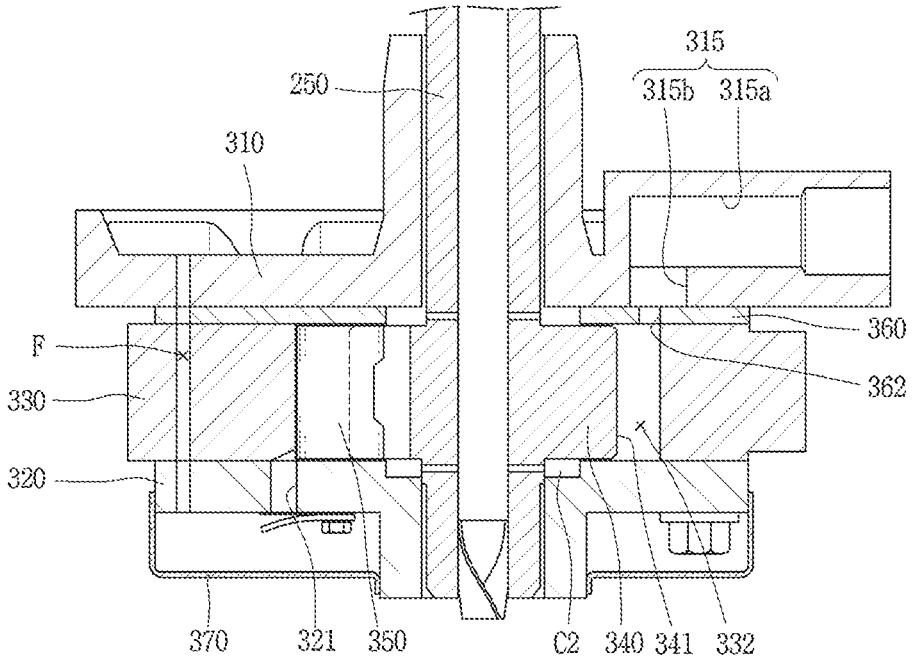

FIG. 13 illustrates another embodiment of the vane-type rotary compressor according to the present disclosure.

That is, in the above-described embodiments, the outlet port is formed on the inner circumferential surface of the cylinder, but in this embodiment, the outlet port 321 is formed in another bearing, that is, the second bearing 320.

In this case, a discharge cover 370 is provided in the second bearing 320, and a discharge passage F (not shown) may be formed to communicating with the upper internal space 110 of the casing 100 in the internal space 371 of the discharge cover 370.

In this case, since the outlet port 321 is not formed on the inner circumferential surface of the cylinder 330 but formed in the second bearing 320, the contact area between the sealing surface of the vane 350 and the inner circumferential surface of the cylinder 330 may be formed uniformly throughout the entire section of the inner circumferential surface of the cylinder 330. Accordingly, in the present embodiment, wear between the cylinder and the vane may be more effectively suppressed as compared with the above-described embodiment.

The foregoing embodiments and advantages are merely exemplary and are not to be considered as limiting the present disclosure. The present teachings may be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A hermetic compressor comprising:

a casing;

a cylinder located inside of the casing and coupled to the casing, the cylinder defining a compression space surrounded by an inner circumferential surface of the cylinder;

a first bearing located at an upper side of the cylinder, the first bearing defining an upper portion of the compression space together with the cylinder;

a second bearing located at a lower side of the cylinder, the second bearing defining a lower portion of the compression space together with the cylinder;

a roller that is located in the compression space and that is configured to rotate along an eccentric path within the compression space to vary a volume of the compression space based on rotation of the roller with respect to the cylinder;

a vane that is located in the roller, that is configured to rotate with respect to the cylinder based on rotation of the roller, and that is configured to, based on rotation of the roller, protrude toward and retract from the inner circumferential surface of the cylinder, the vane dividing the compression space into a plurality of compression chambers;

an inlet port defined in the first bearing;

a refrigerant suction pipe that is inserted into the inlet port through the casing and that is coupled to the inlet port; and an intermediate plate located between the cylinder and the inlet port, the intermediate plate defining a suction passage configured to communicate with the inlet port and the compression space, wherein the suction passage has:

an outer peripheral surface, and an inner peripheral surface that is spaced apart from the outer peripheral surface in a radial direction, the inner peripheral surface having a curved shape that extends from a first end of the suction passage to a second end of the suction passage along a circumferential direction of the cylinder, wherein the inlet port is configured to communicate with the compression space through the suction passage, the inlet port comprising:

a first hole that is defined in a plate portion of the first bearing and that extends from an outer circumferential surface of the plate portion toward a shaft accommodating portion of the first bearing, and a second hole that extends from an inner end of the first hole toward the suction passage and that penetrates a surface of the plate portion facing the suction passage, wherein each of the first hole and the second hole has a circular cross-sectional shape, wherein the inner peripheral surface and the outer peripheral surface of the suction passage extend from the second end of the suction passage toward a contact point between the inner circumferential surface of the cylinder and an outer circumferential surface of the roller, and wherein a peripheral length of the inner peripheral surface of the suction passage is greater than a peripheral length of the outer peripheral surface of the suction passage.

2. The hermetic compressor of claim 1, wherein the suction passage comprises:

a first portion located at a first side with respect to a radial center line that extends from a center of the roller to the suction passage; and a second portion that is located at a second side with respect to the radial center line, a sectional area of the second portion being less than a sectional area of the first portion, and wherein the roller is configured to rotate in a direction from the first side of the radial center line to the second side of the radial center line.

3. The hermetic compressor of claim 2, wherein a cross sectional shape of the suction passage has a first axis and a second axis, and wherein a length of the suction passage in the first axis is greater than a length of the suction passage in the second axis.

4. The hermetic compressor of claim 1, wherein the inlet port comprises an outlet located outside of the compression space, and wherein the inner circumferential surface of the cylinder defines a suction passage that allows the inlet port and the compression space to communicate with each other.

5. The hermetic compressor of claim 4, wherein the suction passage is defined at an edge of the inner circumferential surface of the cylinder.

6. The hermetic compressor of claim 5, wherein the suction passage comprises:

a first portion located at a first side with respect to a radial center line that extends from a center of the roller to the suction passage; and a second portion that is located at a second side with respect to the radial center line, a sectional area of the second portion being less than a sectional area of the first portion, and wherein the roller is configured to rotate in a direction from the first side of the radial center line to the second side of the radial center line.

7. The hermetic compressor of claim 6, wherein a cross sectional shape of the suction passage a first axis and a second axis, and wherein a length of the suction passage in the first axis is greater than a length of the suction passage in the second axis.

8. The hermetic compressor of claim 1, wherein a sectional area of the suction passage is less than or equal to a sectional area of the inlet port.

9. The hermetic compressor of claim 1, wherein a cross sectional shape of the inner circumferential surface of the cylinder is oval.

10. The hermetic compressor of claim 9, further comprising:

a motor located inside of the casing, the motor including a stator and a rotor;

a rotary shaft that connects the rotor of the motor to the roller, the rotary shaft defining an oil passage, wherein the roller defines a vane slot configured to receive the vane and a back pressure hole located at an inner end of the vane slot, and wherein the rotary shaft further defines a back pressure chamber configured to communicate with the back pressure hole in the roller and the oil passage of the rotary shaft.

11. The hermetic compressor of claim 1, wherein the vane is one of a plurality of vanes arranged about a center of the roller.

12. A hermetic compressor comprising:

a cylinder that defines a compression space surrounded by an inner circumferential surface of the cylinder;

a first bearing located at an upper side of the cylinder, the first bearing defining an upper portion of the compression space with the cylinder; and a second bearing located at a lower side of the cylinder, the second bearing defining a lower portion of the compression space together with the cylinder;

an inlet port defined at the first bearing;

a roller that is located in the compression space and that is configured to rotate along an eccentric path within the compression space to vary a volume of the compression space based on rotation of the roller with respect to the cylinder;

a vane that is located in the roller, that is configured to rotate with respect to the cylinder based on rotation of the roller, and that is configured to, based on rotation of the roller, protrude toward and retract from the inner circumferential surface of the cylinder, the vane dividing the compression space into a plurality of compression chambers; and an intermediate plate located between the cylinder and the inlet port, the intermediate plate defining a suction passage configured to communicate with the inlet port and the compression space, wherein the suction passage has:

an outer peripheral surface, and an inner peripheral surface that is spaced apart from the outer peripheral surface in a radial direction, the inner peripheral surface having a curved shape that extends from a first end of the suction passage to a second end of the suction passage along a circumferential direction of the cylinder, wherein the inlet port is configured to communicate with the compression space through the suction passage, the inlet port comprising:

a first hole that is defined in a plate portion of the first bearing and that extends from an outer circumferential surface of the plate portion toward a shaft accommodating portion of the first bearing, and a second hole that extends from an inner end of the first hole toward the suction passage and that penetrates a surface of the plate portion facing the suction passage, wherein each of the first hole and the second hole has a circular cross-sectional shape, wherein the inner peripheral surface and the outer peripheral surface of the suction passage extend from the second end of the suction passage toward a contact point between the inner circumferential surface of the cylinder and an outer circumferential surface of the roller, and wherein a peripheral length of the inner peripheral surface of the suction passage is greater than a peripheral length of the outer peripheral surface of the suction passage.

13. The hermetic compressor of claim 12, wherein the suction passage is further configured to receive refrigerant, the suction passage comprising:

a first portion located at a first side with respect to a radial center line that extends from a center of the roller to a circumferential center of the suction passage; and a second portion that is located at a second side with respect to the radial center line, a sectional area of the second portion being less than or equal to a sectional area of the first portion, and wherein the roller is configured to, based on rotation of the roller, cause the first portion of the suction passage to receive refrigerant before the second portion of the suction passage receives the refrigerant.

14. The hermetic compressor of claim 12, wherein a cross sectional shape of the suction passage has a first axis and a second axis, and wherein a length of the suction passage in the first axis is greater than a length of the suction passage in the second axis.

15. The hermetic compressor of claim 12, wherein the suction passage is located between the inner circumferential surface of the cylinder and the outer circumferential surface of the roller.

16. A hermetic compressor comprising:

a cylinder that defines a compression space surrounded by an inner circumferential surface of the cylinder;

a first bearing located at an upper side of the cylinder, the first bearing defining an upper portion of the compression space with the cylinder; and a second bearing located at a lower side of the cylinder, the second bearing defining a lower portion of the compression space together with the cylinder;

a roller that is located in the compression space and that is configured to rotate along an eccentric path within the compression space to vary a volume of the compression space based on rotation of the roller with respect to the cylinder;

a vane that is located in the roller, that is configured to rotate with respect to the cylinder based on rotation of the roller, and that is configured to, based on rotation of the roller, protrude toward and retract from the inner circumferential surface of the cylinder, the vane dividing the compression space into a plurality of compression chambers;

an inlet port that extends toward an axis of the cylinder; and an intermediate plate located between the cylinder and the inlet port, the intermediate plate defining a suction passage between the inner circumferential surface of the cylinder and an outer circumferential surface of the roller, wherein the suction passage has:

an outer peripheral surface, and an inner peripheral surface that is spaced apart from the outer peripheral surface in a radial direction, the inner peripheral surface having a curved shape that extends from a first end of the suction passage to a second end of the suction passage along a circumferential direction of the cylinder, wherein the inlet port is configured to supply refrigerant to the compression space through the suction passage, the inlet port comprising:

a first hole that is defined in a plate portion of the first bearing and that extends from an outer circumferential surface of the plate portion toward a shaft accommodating portion of the first bearing, and a second hole that extends from an inner end of the first hole toward the suction passage and that penetrates a surface of the plate portion facing the suction passage, wherein each of the first hole and the second hole has a circular cross-sectional shape, wherein the inner peripheral surface and the outer peripheral surface of the suction passage extend from the second end of the suction passage toward a contact point between the inner circumferential surface of the cylinder and an outer circumferential surface of the roller, and wherein a peripheral length of the inner peripheral surface of the suction passage is greater than a peripheral length of the outer peripheral surface of the suction passage.

17. The hermetic compressor of claim 16, wherein the suction passage is configured to communicate with the inlet port and the compression space.

18. The hermetic compressor of claim 1, wherein the first end of the suction passage extends along a straight line and connects the outer peripheral surface of the suction passage to the inner peripheral surface of the suction passage in the radial direction.

* * * * *